United States Patent [19]

Cordiano et al.

[11] 4,002,394

[45] Jan. 11, 1977

[54] SINGLE LATCH SNAP-LOCK BASE FOR ANNULAR FLUORESCENT LAMPS

[75] Inventors: Dominic D. Cordiano, South Euclid; Joseph D. Kastelic, Euclid; Vernon E. Thomas, Rocky River, all of Ohio

[73] Assignee: General Electric Company, Schenectady, N.Y.

[22] Filed: Oct. 10, 1975

[21] Appl. No.: 621,500

[52] U.S. Cl. ..... 339/50 C; 339/145 D

[51] Int. Cl.[2] ..... H01R 33/74

[58] Field of Search ..... 339/50 C, 145 R, 145 D, 339/206 L, 208, 210; 240/51.12; 313/49, 51, 318

[56] References Cited

UNITED STATES PATENTS

| | | | |
|---|---|---|---|
| 2,597,666 | 5/1952 | Oday et al. | 339/145 D |
| 2,626,977 | 1/1953 | Hinman | 339/145 D |
| 2,733,417 | 1/1956 | Hinman et al. | 339/50 C |
| 2,802,191 | 8/1957 | Nicolaro | 339/145 D |
| 3,354,454 | 11/1967 | Rueger | 339/208 X |
| 3,546,523 | 12/1970 | Gilbert | 313/49 X |
| 3,858,162 | 12/1974 | Mai et al. | 339/145 D |
| 3,898,495 | 8/1975 | Livera | 339/50 C X |

*Primary Examiner*—Gerald A. Dost

*Attorney, Agent, or Firm*—Paul F. Wille; Lawrence R. Kempton; Frank L. Neuhauser

[57] ABSTRACT

A plastic base for annular fluorescent lamps is disclosed comprising two semicylindrical parts. A first part comprises a dowel and a latch pin extending from the interior thereof; the second part comprising recesses for receiving the dowel and latch pin for securing the two parts in a fixed relationship. Additional means are provided for reducing the possibility of short circuits across the electrical leads. Also, the parts are shaped to require a minimum of undercuts, thereby simplifying the fabrication thereof.

11 Claims, 3 Drawing Figures

SINGLE LATCH SNAP-LOCK BASE FOR ANNULAR FLUORESCENT LAMPS

BACKGROUND OF THE INVENTION

This invention relates to bases for a fluorescent lamp and, in particular, to a base for an annular fluorescent lamp.

In the prior art, annular fluorescent lamp bases typically comprised two halves fastened together with a self-tapping screw, wherein each half comprises a thermosetting, compression-molded plastic. In addition, the bases were typically designed to have an outside diameter (o.d.) approximately equal to the diameter of the tubing from which the lamp is made. Thus, the base had to fit between the ends of the lamp. Since manufacturing tolerances permit some variation in the end spacing, it was necessary to stock a number of bases of different sizes. The bases of the prior art were thus expensive to manufacture and assemble.

Some bases of more recent design, e.g., U.S. Pat. Nos. 3,858,162 and 3,898,495, utilizes a snap-lock design to simplify assembly of the base, eliminating the need for the self-tapping screw. The fabrication of the base parts, however, requires complicated and expensive tooling for the enclosed undercuts. Further, both require flexing of the outside wall of the base for disassembly, whereas rigid outside walls are preferred. In addition, the bases are difficult to disassemble due to the use of two interlocking elements.

SUMMARY OF THE INVENTION

In view of the foregoing, it is therefore an object of the present invention to provide a base having a rigid exterior for annular fluorescent lamps.

Another object of the present invention is to provide a lamp base for annular lamps which is tolerant of end space variations.

A further object of the present invention is to provide a more easily assembled lamp base.

Another object of the present invention is to provide a lamp base for annular fluorescent lamps which is less expensive to manufacture.

The foregoing objects are achieved in the present invention wherein the base is formed by two semicylindrical pieces. A first piece has a recess formed in the semicylindrical outer wall thereof for receiving contact pins, the recess forming a boss on the concave side of said outer wall. Partition means are formed on said boss for further electrically isolating the contact pins. Annular ring segments orthogonal to and on the concave side of the outer wall stiffen the wall to prevent flexing thereof. Also, the annular ring segments are positioned relative to the partitions to define two channels for receiving a dowel and locking pin from the second part of the base. A relief aperture formed in the boss and a portion of the partition means through which the mold forms a shoulder for engaging the latch pin.

The second piece comprises a semicylindrical outer wall having a semicircular wall orthogonal thereto for stiffening the outer wall. Protruding from and in the plane of the semicircular wall are the dowel and locking pin. Also provided are wall means for preventing the rotation of the assembled base about the lamp.

The first piece is provided with shoulders formed on the concave side thereof for limiting the motion of the joined base pieces along the circular axis of the toroid formed by the assembled lamp. In addition, the end portions of the joined pieces define an inside diameter greater than the outside diameter of the glass tubing from which the lamp is made.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
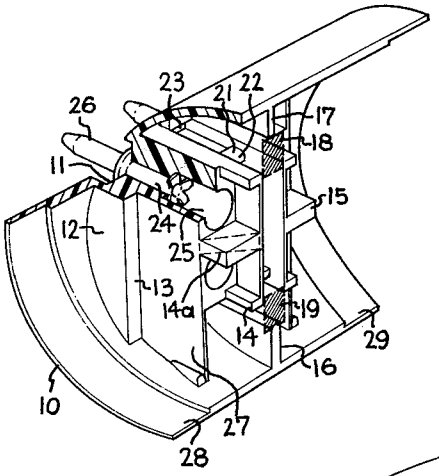
FIG. 1 is a perspective view of the contact pin half of the base.

Referring to FIG. 1, the contact pin half of the base in accordance with the present invention comprises a semicylindrical outer wall 10 having a centrally located recess 11 formed in the convex side thereof, which forms a boss 12 in the interior thereof. Shoulder 13 is part of boss 12 and serves to limit the motion of the joined base pieces along the circular axis of the toroid formed by the assembled lamp. Shoulder 13 also adds material around recess 11 to strengthen the part.

Partition means 14 and 15, in the shape of broadened "T's", having the arms thereof adjacent each other. Annular ring segments 16 and 17 are positioned approximately at the middle of the space between partitions 14 and 15 and serve to define channels 18 and 19 with the extremities of the arms of partition means 14 and 15. Channels 18 and 19 receive the dowel and locking pin described in connection with FIG. 2. Depending upon the size of the gap between the ends of the lamp envelope, it may be desirable to have the stem of one of the T's of reduced height, as indicated by dashed line 14*a*, to clear the exhaust tip of the bulb.

In channel 18, shoulder 21 interconnects partition means 14 and 15 and provides the locking mechanism for receiving the locking pin from the other half of the base. Shoulder 21 is provided with bevel 22 for facilitating the insertion of the locking pin. At the end of channel 18, aperture 23 is formed in semicylindrical outer wall 10. Aperture 23 performs two functions. It provides an access for releasing the locking pin in the event it is desired to disassemble the lamp. In addition, aperture 23 enables shoulder 21 to be formed in the contact pin half of the base in a mold having no movable parts. Thus, the tooling required to make the contact pin half of the base is less expensive than required by the prior art. At the same time, even though the mold for forming the contact pin half of the base has no movable parts, the contact pin half of the base is readily removed from the mold after forming.

The four areas in boss 12 defined by partition means 14 and 15 each have a bore 24 and an enlarged outer bore 25. Bore 24 receives contact pin 26 which is fastened thereto, for example, by flaring the interior end of pin 26 to attach the pin to the base. Enlarged bore 25 provides additional separation of the contact leads, in addition to partitions 14 and 15, thereby further reducing the chances for a short circuit between the leads coming from the annular lamp. In addition to annular ring segments 16 and 17, the rigidity of the base half is further assured by wall 27 which continues from boss 12 to engage the interior side of semicylindrical outer wall 10. While the inside diameter of outer wall 10 is intended to be larger than the outside diameter of the glass tubing from which the lamp is made, the edges of outer wall 10 can be rabbeted as indicated by channels 28 and 29 to provide further clearance. This enables semicylindrical outer wall 10 to have a reduced outside diameter than would otherwise be required if outer wall 10 were of full thickness to the ends thereof and adds some flexibility to the outer wall allowing a wider tolerance.

While the perspective view of the contact pin half of the base illustrated in FIG. 1 reveals the features of the base in accordance with the present invention, it is understood that the contact pin half of the base is essentially symmetrical in the preferred embodiment of the present invention. In other words, for example, while not visible in the illustration of FIG. 1, there is an additional shoulder on the other side of boss 12 which is hidden from view. An exception to this is that, in the preferred embodiment of the present invention, shoulder 21 and aperture 23 are provided only on one side of the contact half of the base. Channel 19 is an open channel for receiving a dowel not having any locking mechanism thereon. If desired, while it would slightly increase the force necessary to attach the base halves and make it somewhat more difficult to disassemble the base halves, channel 19 could also be provided with a shoulder and aperture.

Figure 2:
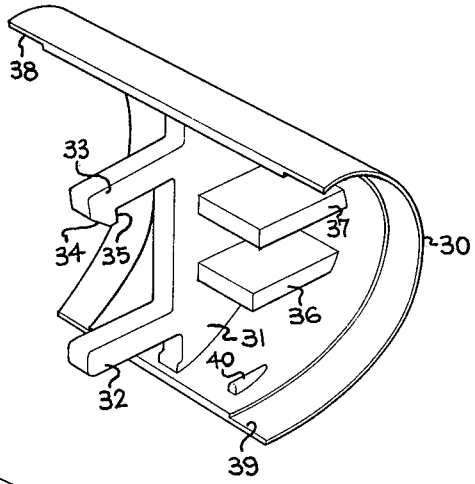
FIG.2 is a perspective view of the leg half of the base.

FIG. 2 illustrates the locking pin half of the base in accordance with the present invention. Specifically, a semicylindrical outer wall 30 is provided with a semicircular wall or disc 31 on the interior thereof for stiffening the outer wall. Protruding from semicircular wall 31 and formed as part thereof are a pair of legs, specifically dowel 32 and locking pin 33. Locking pin 33 is provided with a latching shoulder 35 and a beveled portion 34 for facilitating the engagement of the two halves of the base and disassembly of the halves. Extending orthogonally from the plane of the semicircular wall are walls 36 and 37 which are spaced apart slightly and serve to prevent the rotation of the assembled base about the lamp. As is known in the art, these rotation prevention means engage glass nodules molded in the sealed end of the lamp envelope or a tang on a metal cap that is attached to one of the ends of the envelope.

As with the contact pin half, the ends of semicylindrical outer wall 30 are provided with a rabbeted edge treatment 38 and 39 for assuring an inside diameter greater than the outside diameter of the glass envelope of the lamp. As noted in connection with FIG. 1, it is preferred that dowel 32 not be provided with a locking or latch mechanism for engaging the contact pin half. However, if desired, dowel 32 could also be provided with a locking shoulder 35 and bevel portion 34.

The various pads illustrated in FIGS. 1 and 2, such as pad 40, are utilized in the fabrication of the base halves to facilitate the release thereof from the molds.

While the base halves of the present invention can be fabricated a number of ways using a variety of insulating materials, it is preferred that a thermoplastic be utilized and that the halves be injection molded, both of which are well known per se in the art. A suitable plastic is a phenylene oxide based resin such as sold under the trade name "Noryl SE1" by General Electric Company. Other thermoplastics may also be utilized, considering the cost, density, resilience, and temperature stability of the plastic. As previously noted, the base halves in accordance with the present invention are more readily fabricated than those of the prior art, requiring less expensive tooling, since there is only one undercut in the entire base assembly. This undercut is that required to form latching means 35. As understood by those familiar with the molding art, latch 35 is readily formed using what is known as a side-acting cam in the mold. This is a relatively simple mechanism and does not add appreciably to the cost of the dies used in making the base halves in accordance with the present invention.

Figure 3:
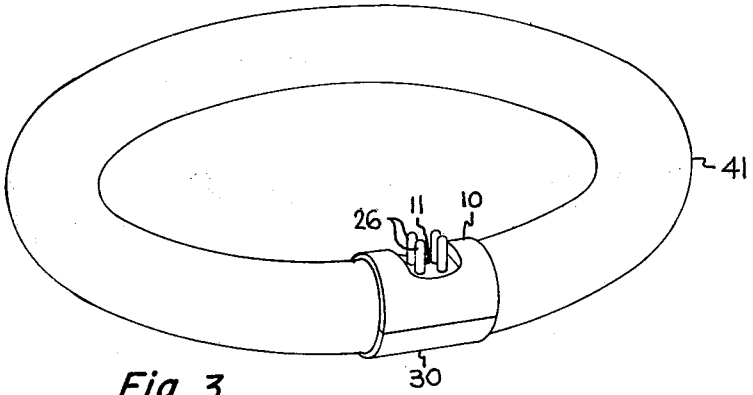
FIG. 3 illustrates an assembled lamp in accordance with the present invention.

FIG.3 illustrates an assembled lamp with a base in accordance with the present invention. As illustrated in FIG. 3, lamp envelope 41 has an outside diameter less than the inside diameter of the cylinder defined by base halves 10 and 30. This enables a single base to be utilized for the annular fluorescent lamps regardless of manufacturing variations in the spacing between the sealed ends of the glass envelope. Thus, the number of parts which must be maintained in adequate supply is reduced, and the assembly of the lamp is simplified since the sealed glass envelope does not have to be inspected for a preliminary determination of the proper base size. The base in accordance with the present invention further facilitates lamp fabrication by eliminating the need for a fastening screw to attach the base halves together. In addition, the base halves are readily assembled with a gentle squeezing action and, while securely fastened, are readily separated by inserting a tool through the access hole formed in the contact pin recess.

There is thus provided by the present invention an improved base for annular fluorescent lamps which is easily fabricated, easily assembled, lower in cost, rigid, securely fastened about the sealed ends of the fluorescent lamp and yet readily disassembled should the need arise during the manufacture of the lamp.

Having thus described the present invention, it will be apparent to those of ordinary skill in the art that various modifications can be made within the spirit and scope of the present invention. For example, while illustrated as comprising what may be termed a contact pin half, having channels, and a leg half, having the dowel and locking pin, the parts of the base could have one leg and one channel each or the legs and channels interchanged. Since the requirement of resiliency applies only to the base half having locking pin 33, the other half could be made out of a more rigid material, e.g., styrene. Also, while the mating ends of outer walls 10 and 30 are illustrated as straight lines, it is understood they could be curved in their common plane to better fit the bulb when positioned as shown in FIG. 3.

What we claim as new and desire to secure by Letters Patent of the United States is:

1. A base for an annular lamp comprising:

a pair of parts having a semicylindrical external surface, said parts containing channels and legs having fitted cross sections formed on the interior thereof and spaced from said external surface;

at least one of said legs comprising locking means and at least the one of said channels receiving said one leg comprising means for engaging said locking means;

a recess formed in one of said parts for receiving electrically conductive contact pins, said recess forming a boss on the interior of said part; and reinforcing means on the interior of said parts and located at the middle portion thereof for preventing flexure of said portion, said reinforcing means comprising semicircular discs orthogonal to said surface and connecting said boss to the inner surface of said one part and attached to the interior of the other part.

2. The base as set forth in claim 1 wherein said legs comprise a pair of legs in the plane of said disc and extending away from said disc.

3. The base as set forth in claim 2 and further comprising:

partition means formed on said boss for dividing the upper surface of said boss into smaller areas.

4. The base as set forth in claim 3 wherein said partition means are in the form of broadened T's oriented top to top so that the arms of the T are parallel and, together with said annular ring segments, define said channels.

5. A base as set forth in claim 4 wherein said boss further comprises a shoulder on at least one side of said boss for limiting the movement of the assembled base along the circular axis of the toroid formed by the annular lamp and base.

6. The base as set forth in claim 2 wherein said reinforcing means comprises annular ring segments orthogonal to and attached to the interior of the semicylindrical surface of said one part, said annular ring segments positioned relative to said partition means to define a pair of said channels therebetween.

7. The base as set forth in claim 6 wherein said one channel communicates through said semicylindrical surface to form an aperture, wherein said leg having means for engaging said locking means does not extend into said aperture and said aperture provides access to said channel for disengaging said leg.

8. An annular fluorescent lamp comprising:

an annular glass envelope having spaced apart sealed ends;

a base enclosing said ends and the space therebetween, said base comprising:

two parts, each part having an outer wall in the shape of a semicylindrical surface, the ends of said outer wall when joined defining a cylinder having an inside diameter larger than the outside diameter of the tube forming said glass envelope;

a first part having a recess centrally located therein for receiving electrically conductive contact pins, said recess forming a boss on the interior of said part and having bores therein for said contact pins, said boss having counterbores therein aligned with and of a larger diameter than said bores;

partition means on said boss located relative to said counterbores for electrically isolating said counterbores;

stiffening means comprising annular ring segments orthogonal to and centrally located on the interior of the wall of said first part, said stiffening means and said partition means defining channels therebetween;

locking means located in at least one of said channels;

said second part having a centrally located semicircular disc orthogonal to the wall thereof;

a pair of legs in the plane of said disc and extending therefrom, said legs and said channels having fitted cross sections and at least one of said legs having means for engaging said locking means, thereby securing said parts together.

9. The lamp as set forth in claim 8 wherein the ends of said parts are rabbeted.

10. The lamp as set forth in claim 8 and further comprising:

wall means interconnecting said boss and said outer wall for further stiffening the outer wall of said first part.

11. The lamp as set forth in claim 8 wherein said one channel extends through the outer wall to provide access to said engaged leg and locking means when said parts are joined together.

* * * * *